US011000442B2

(12) United States Patent
Ramos

(10) Patent No.: US 11,000,442 B2
(45) Date of Patent: May 11, 2021

(54) MOBILITY TOOL

(71) Applicant: Victor Ramos, Miami Beach, FL (US)

(72) Inventor: Victor Ramos, Miami Beach, FL (US)

( * ) Notice: Subject to any disclaimer, the term of this patent is extended or adjusted under 35 U.S.C. 154(b) by 190 days.

(21) Appl. No.: 16/253,631

(22) Filed: Jan. 22, 2019

(65) Prior Publication Data

US 2020/0230016 A1 Jul. 23, 2020

(51) Int. Cl.
*A61H 3/06* (2006.01)
*H04R 1/10* (2006.01)

(52) U.S. Cl.
CPC ..... *A61H 3/061* (2013.01); *A61H 3/068* (2013.01); *H04R 1/1016* (2013.01); *H04R 1/1041* (2013.01); *H04R 1/1075* (2013.01)

(58) Field of Classification Search
CPC ..... A61H 3/068; A61H 3/06; A61H 3/061; A61H 2003/063; A61H 2003/065; H04R 1/10; H04R 1/1008; H04R 1/1016; H04R 1/1025; H04R 1/1033; H04R 1/1041; H04R 1/105; H04R 1/1058; H04R 1/1066; H04R 1/1075; H04R 1/1083; H04R 1/1091
See application file for complete search history.

(56) References Cited

U.S. PATENT DOCUMENTS

D325,670 S 4/1992 Champigny
5,687,136 A 11/1997 Borenstein
5,973,618 A * 10/1999 Ellis ..... G08G 1/127 340/990
6,356,210 B1 * 3/2002 Ellis ..... G09B 21/006 340/990
6,489,605 B1 * 12/2002 Ritz ..... A61F 9/08 250/221
6,774,795 B2 8/2004 Eshelman
6,853,909 B2 2/2005 Scherzinger
7,267,281 B2 9/2007 Hopkins
8,812,231 B1 8/2014 Brickous
9,044,374 B1 * 6/2015 Stimpson ..... A61H 3/061
9,770,382 B1 * 9/2017 Ellis ..... A61H 3/061
10,098,807 B1 * 10/2018 Terrell ..... A61H 3/061
10,134,304 B1 * 11/2018 Beals ..... G01S 17/86
10,575,083 B2 * 2/2020 Perianu ..... H04W 4/80
2006/0028544 A1 2/2006 Tseng
2006/0108426 A1 * 5/2006 Hopkins ..... A61H 3/061 235/462.45
2006/0129308 A1 * 6/2006 Kates ..... A61H 3/066 701/532

(Continued)

*Primary Examiner* — Thomas G Black
*Assistant Examiner* — Sara J Lewandroski

(57) ABSTRACT

A mobility tool for the blind and visually impaired includes a rod and an earpiece. The earpiece is configured to position on an ear of a user so that a first speaker is positioned proximate to an ear canal of the ear. A sensing module is coupled to a lower end of the rod and is configured to detect a temperature hazard, a water hazard, and a traffic hazard. A navigation and communications module is coupled to an upper end of the rod and is operationally coupled to the sensing module and the earpiece. The navigation and communications module comprises a GPS transceiver that is configured to send and receive location coordinates. The sensing module is configured to detect a respective hazard along a route, positioning the first speaker to selectively broadcasting directions for the route and a warning of the respective hazard to the user.

17 Claims, 5 Drawing Sheets

(56) References Cited

U.S. PATENT DOCUMENTS

| | | | | |
|---|---|---|---|---|
| 2008/0251110 | A1 | 10/2008 | Pede | |
| 2009/0032590 | A1* | 2/2009 | Hopkins | A61H 3/061 235/385 |
| 2011/0054773 | A1 | 3/2011 | Chi | |
| 2012/0279539 | A1* | 11/2012 | Kim | A61H 3/061 135/66 |
| 2014/0009915 | A1* | 1/2014 | Nievas | A45B 3/04 362/102 |
| 2014/0379251 | A1* | 12/2014 | Tolstedt | A61H 3/068 701/411 |
| 2015/0070479 | A1* | 3/2015 | Yu | A61H 3/068 348/62 |
| 2017/0006981 | A1* | 1/2017 | Samson | G01S 19/14 |
| 2017/0180843 | A1* | 6/2017 | Perianu | H04W 76/10 |
| 2018/0356233 | A1* | 12/2018 | Baqain | A61H 3/068 |
| 2019/0155404 | A1* | 5/2019 | Cutrell | G06F 3/011 |
| 2019/0307633 | A1* | 10/2019 | Ceylan | A61H 3/068 |

* cited by examiner

MOBILITY TOOL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to mobility tools and more particularly pertains to a new mobility tool for the blind and visually impaired.

BRIEF SUMMARY OF THE INVENTION

An embodiment of the disclosure meets the needs presented above by generally comprising a rod and an earpiece. The earpiece is configured to position on an ear of a user so that a first speaker is positioned proximate to an ear canal of the ear. A sensing module is coupled to a lower end of the rod and is configured to detect a temperature hazard, a water hazard, and a traffic hazard. A navigation and communications module is coupled to an upper end of the rod and is operationally coupled to the sensing module and the earpiece. The navigation and communications module comprises a GPS transceiver that is configured to send and receive location coordinates. The sensing module is configured to detect a respective hazard along a route, positioning the first speaker to selectively broadcasting directions for the route and a warning of the respective hazard to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
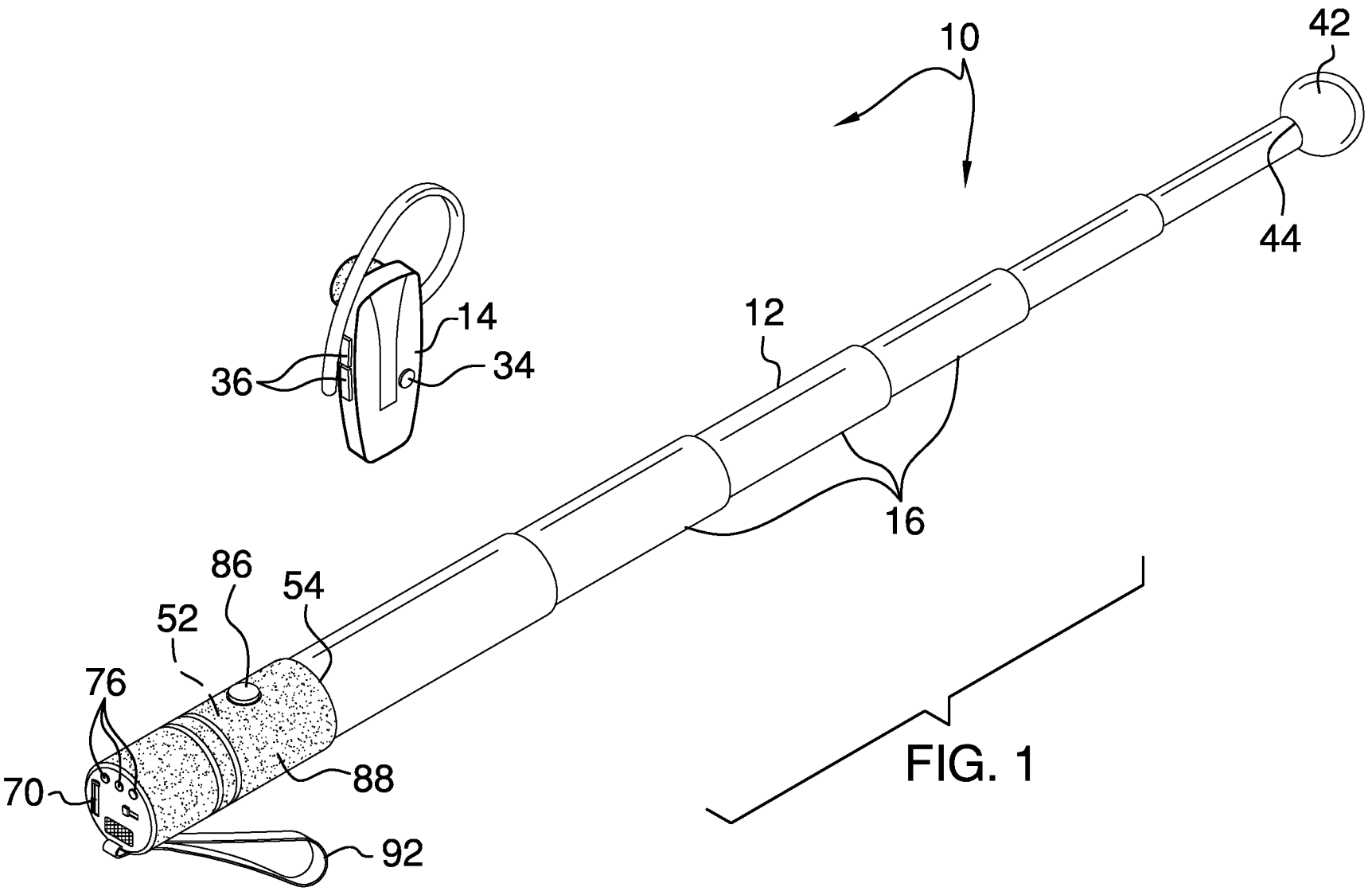
FIG. 1 is an isometric perspective view of a mobility tool according to an embodiment of the disclosure.

With reference now to the drawings, and in particular to FIGS. 1 through 5 thereof, a new mobility tool embodying the principles and concepts of an embodiment of the disclosure and generally designated by the reference numeral 10 will be described.

As best illustrated in FIGS. 1 through 5, the mobility tool 10 generally comprises a rod 12 and an earpiece 14. The rod 12 comprises a plurality of nested sections 16 so that the rod 12 is selectively extensible. The plurality of nested sections 16 comprises six nested sections 16, as shown in FIG. 1. The rod 12 is colored to designate a user as being at least one of visually impaired and blind. The coloring scheme used for the rod 12 varies according to the requirements of the local of the user.

Figure 5:
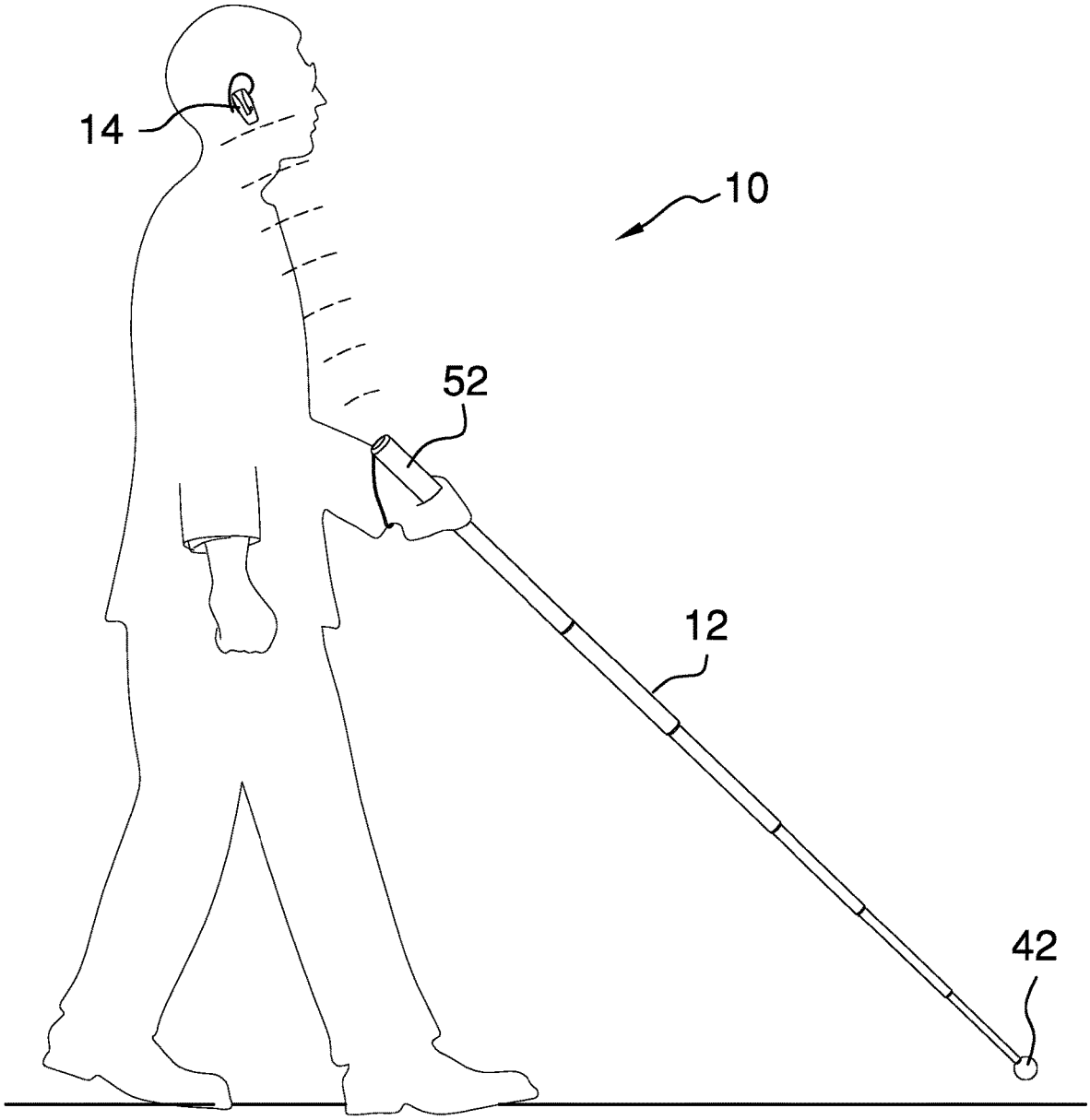
FIG. 5 is an in-use view of an embodiment of the disclosure.

The earpiece 14 comprises a first speaker 18 and is configured to position on an ear of the user so that the first speaker 18 is positioned proximate to an ear canal of the ear, as shown in FIG. 5. The earpiece 14 comprises a first housing 20 that defines an interior space 22. The first speaker 18 is coupled to and extends from the first housing 20. An earhook 24 is coupled to and extends arcuately from the first housing 20. The earhook 24 is configured to position over a top of the ear to couple the first housing 20 to the user.

A first battery 26, a first microprocessor 28, and a first transceiver 30 are coupled to the first housing 20 and are positioned in the interior space 22. The first microprocessor 28 is operationally coupled to the first battery 26, the first speaker 18, and the first transceiver 30.

A first switch 32 is coupled to the first housing 20 and is operationally coupled to the first microprocessor 28 and the first battery 26. The first switch 32 is toggle type. The first switch 32 is configured to be toggled to selectively couple the first microprocessor 28 to the first battery 26 to power the earpiece 14.

A first distress button 34 is coupled to the first housing 20 and is operationally coupled to the first microprocessor 28. The first distress button 34 is selectively depressible. The first distress button 34 is configured to be depressed to signal the first microprocessor 28 in event of an emergency.

A first volume controller 36 is coupled to the first housing 20. The first volume controller 36 is operationally coupled to the first microprocessor 28. The first volume controller 36 is positioned to signal the first microprocessor 28 to selectively adjust a volume of the first speaker 18. The first volume controller 36 comprises an increase button 38 and a decrease button 40. The increase button 38 and the decrease button 40 are depressible. The increase button 38 is configured to be depressed to increase the volume of the first speaker 18. The decrease button 40 is configured to be depressed to decrease the volume of the first speaker 18.

A sensing module 42 is coupled to a lower end 44 of the rod 12, as shown in FIG. 1. The sensing module 42 comprises a temperature sensor 46, a moisture sensor 48, and a motion sensor 50 and is configured to detect a temperature hazard, a water hazard, and a traffic hazard.

A navigation and communications module 52 is coupled to an upper end 54 of the rod 12, as shown in FIG. 1. The navigation and communications module 52 is operationally coupled to the sensing module 42 and the earpiece 14. The navigation and communications module 52 comprises a Global Positioning System (GPS) transceiver 56.

The GPS transceiver 56 is configured to send and receive location coordinates. The sensing module 42 is configured to detect a respective hazard along the route, positioning the first speaker 18 to selectively broadcast directions for the route and a warning of the respective hazard to the user.

The navigation and communications module 52 comprises a second housing 58 that is coupled to and extends linearly from the upper end 54 of the rod 12. The second housing 58 defines an internal space 60. The GPS transceiver 56 is coupled to the second housing 58 and positioned in the internal space 60.

A second battery 62, a second microprocessor 64, and a second transceiver 66 are coupled to the second housing 58 and are positioned in the internal space 60. The second microprocessor 64 is operationally coupled to the second battery 62, the GPS transceiver 56, and the second transceiver 66. The second transceiver 66 is positioned to receive a distress signal from the first transceiver 30, upon depressing of the first distress button 34, positioning the second microprocessor 64 to actuate the GPS transceiver 56 to communicate a distress signal and location coordinates to emergency services.

Figure 2:
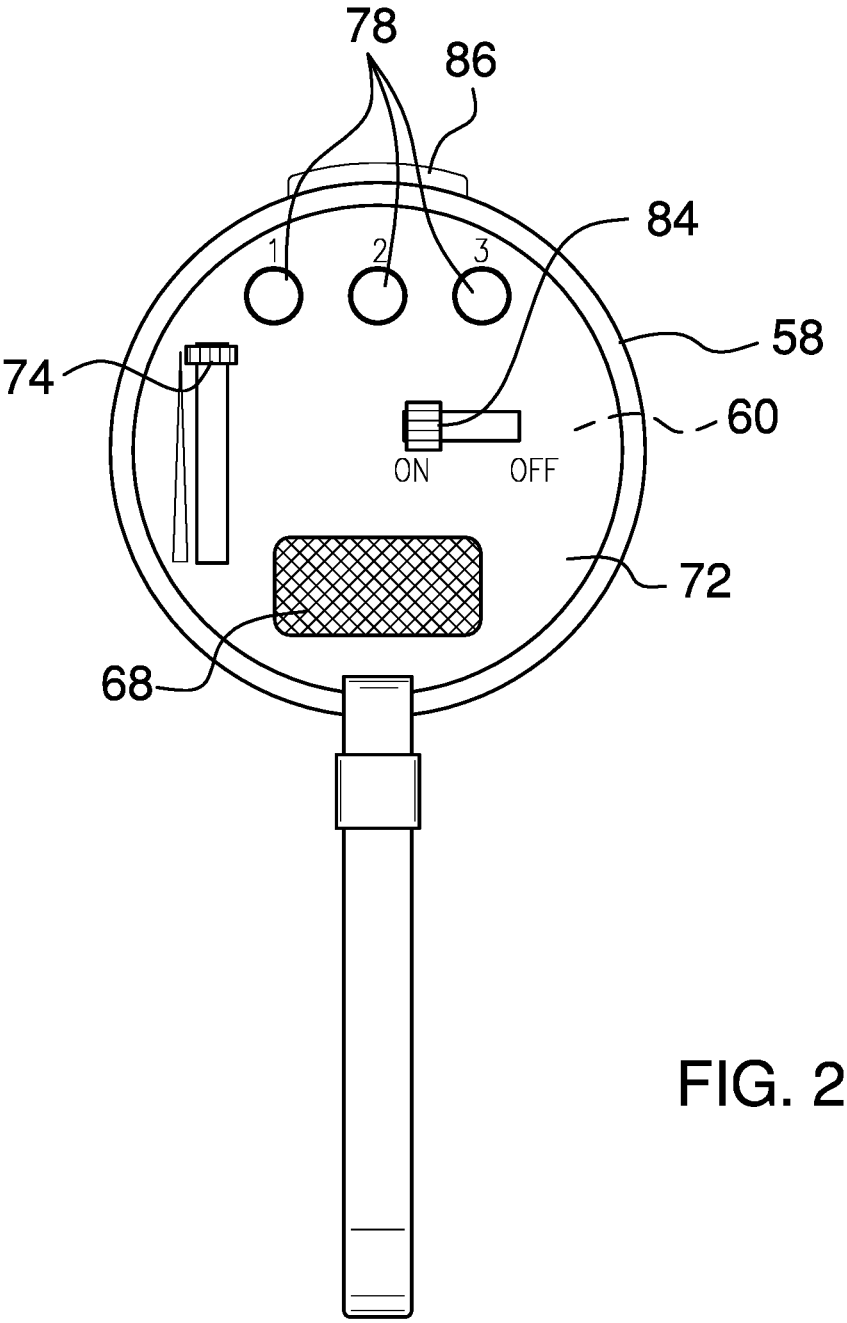
FIG. 2 is a top view of an embodiment of the disclosure.

A second speaker 68 and a second volume controller 70 are coupled to an upper face 72 of the second housing 58, as shown in FIG. 2. The second speaker 68 and the second volume controller 70 are operationally coupled to the second microprocessor 64. The second microprocessor 64 is positioned to selectively actuate the second speaker 68 to broadcast the directions and the warning of the respective hazard to the user, allowing the rod 12 to be used without the earpiece 14. The second volume controller 70 is positioned to signal the second microprocessor 64 to selectively adjust a volume of the second speaker 68.

The second volume controller 70 is slide-switch type. A knob 74 of the second volume controller 70 is configured to be selectively slid relative to the upper face 72 of the second housing 58 to increase and decrease the volume of the second speaker 68.

A navigational controller 76 is coupled to the upper face 72 of the second housing 58. The navigational controller 76 is operationally coupled to the second microprocessor 64. The navigational controller 76 is configured to select from a plurality of preset destinations, positioning the second microprocessor 64 to actuate the GPS transceiver 56 to direct the user on a route to a respective preset destination.

The navigational controller 76 comprises a set of three navigation buttons 78. The navigation buttons 78 are depressible. Each navigation button 78 is configured to be depressed to signal the second microprocessor 64 to actuate the GPS transceiver 56 to direct the user on the route to the respective preset destination.

Navigational programming code 80 is positioned on an electronic device of the user that enables the user to communicate with the navigation and communications module 52, via the second transceiver 66, to input the plurality of preset destinations into the second microprocessor 64.

A clock 82 is coupled to the second housing 58 and positioned in the internal space 60. The clock 82 is operationally coupled to the second microprocessor 64. The clock 82 is positioned to signal a time to the second microprocessor 64, positioning the second microprocessor 64 to selectively actuate the first speaker 18 and the second speaker 68 to broadcast the time to the user.

A second switch 84 is coupled to the upper face 72 of the second housing 58. The second switch 84 is operationally coupled to the second microprocessor 64 and the second battery 62. The second switch 84 is toggle type. The second switch 84 is configured to be toggled to selectively couple the second microprocessor 64 to the second battery 62 to power the navigation and communications module 52.

A second distress button 86 is coupled to the second housing 58. The second distress button 86 is operationally coupled to the second microprocessor 64. The second distress button 86 is selectively depressible. The second distress button 86 is configured to be depressed to signal the second microprocessor 64 to actuate the GPS transceiver 56 to communicate the distress signal and the location coordinates to the emergency services. The second distress button 86 enables the user to communicate the distress signal and the location coordinates to the emergency services when not using the earpiece 14.

Figure 3:
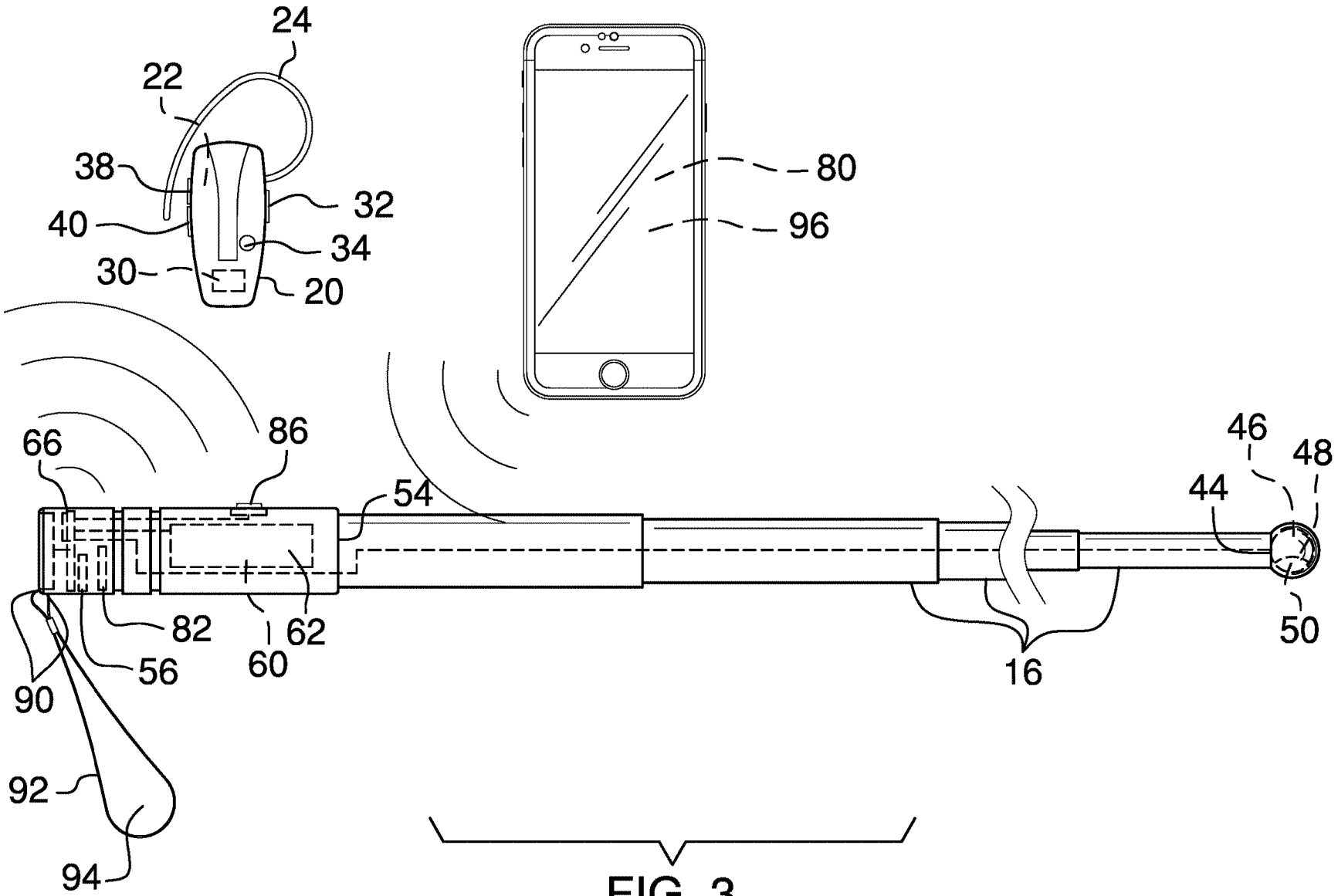
FIG. 3 is a side view of an embodiment of the disclosure.
Figure 4:
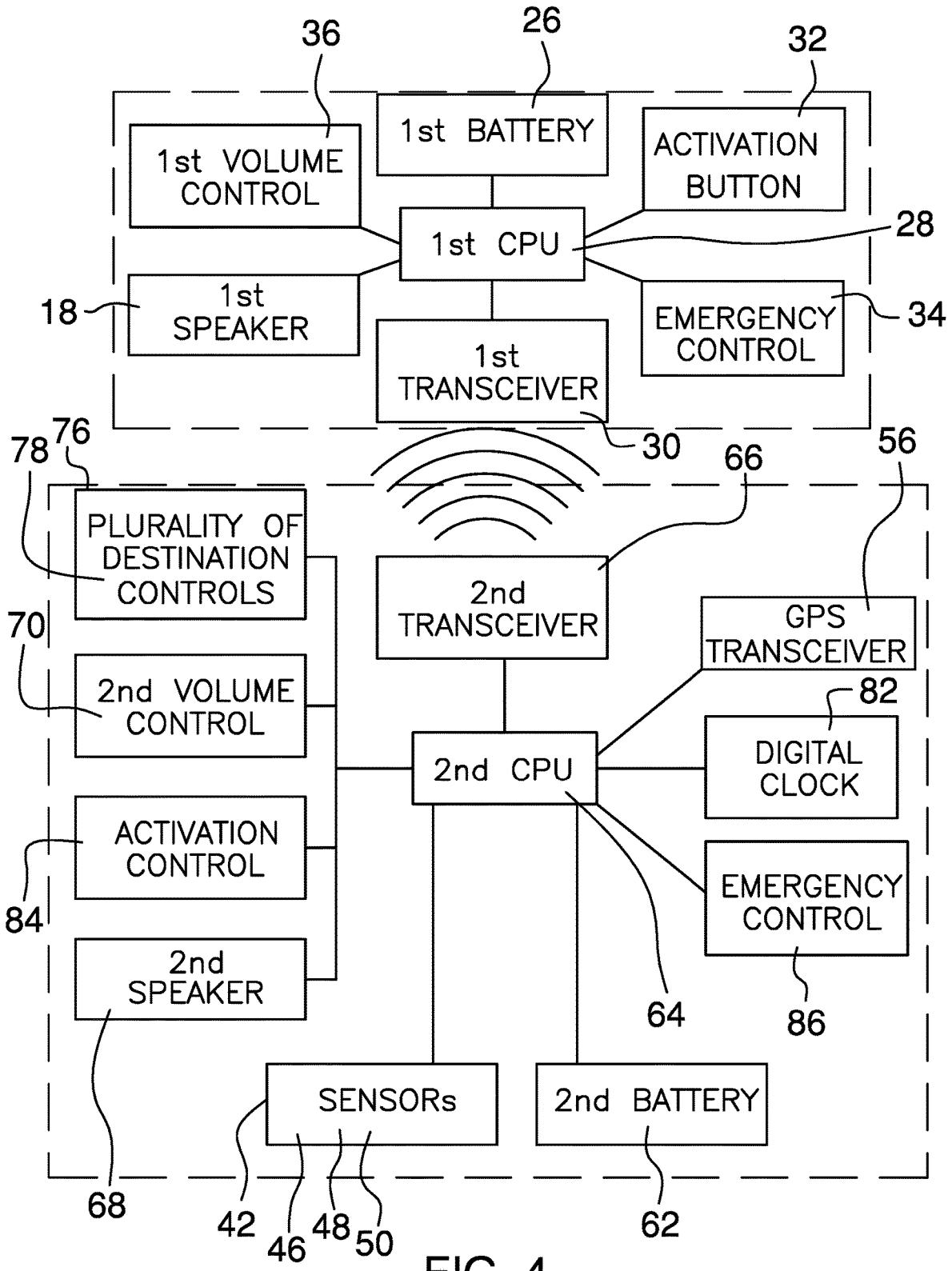
FIG. 4 is a block diagram of an embodiment of the disclosure.

A grip 88 is coupled to the second housing 58, as shown in 1. The grip 88 is configured to enhance a grasp of the hand of the user upon the second housing 58. Opposing ends 90 of a strap 92 are coupled to the second housing 58, as shown in FIG. 3, to defines a loop 94 that is configured to insert the hand of the user to couple the rod 12 to the user.

Tracking programming code 96 is positioned on the electronic device of the user that enables the user to grant access to another party, such as a family member, to receive the location coordinates from the GPS transceiver 56.

In use, the user selects a respective preset destination using the set of three navigation buttons 78 to signal the second microprocessor 64 to actuate the GPS transceiver 56 to direct the user on the route to the respective preset destination. The sensing module 42 is configured to detect the temperature hazard, the water hazard, and the traffic hazard that might occur along the route, positioning the first speaker 18 and the second speaker 68 to selectively broadcast the warning of the respective hazard to the user. In the event the emergency services are required, the first distress button 34 and the second distress button 86 can be selectively depressed to signal the second microprocessor 64 to actuate the GPS transceiver 56 to communicate the distress signal and the location coordinates to the emergency services.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A mobility tool comprising:

a rod;

an earpiece comprising a first speaker, the earpiece being configured for positioning on an ear of a user such that the first speaker is positioned proximate to an ear canal of the ear;

a sensing module coupled to a lower end of the rod, the sensing module comprising a temperature sensor, a moisture sensor, and a motion sensor wherein the sensing module is configured for detecting a temperature hazard, a water hazard, and a traffic hazard;

a navigation and communications module coupled to an upper end of the rod, the navigation and communications module being operationally coupled to the sensing module and the earpiece, the navigation and communications module comprising a GPS transceiver wherein the GPS transceiver is configured for receiving location coordinates, wherein the sensing module is configured for detecting a respective hazard along a route, positioning the first speaker for selectively broadcasting directions for the route and a warning of the respective hazard to the user;

the earpiece comprising:

a first housing defining an interior space, the first speaker being coupled to and extending from the first housing, an earhook coupled to and extending arcuately from the first housing wherein the earhook is configured for positioning over a top of the ear for coupling the first housing to the user, a first battery coupled to the first housing and positioned in the interior space, a first microprocessor coupled to the first housing and positioned in the interior space, the first microprocessor being operationally coupled to the first battery and the first speaker, a first transceiver coupled to the first housing and positioned in the interior space, the first transceiver being operationally coupled to the first microprocessor, a first switch coupled to the first housing, the first switch being operationally coupled to the first microprocessor and the first battery, the first switch being toggle type wherein the first switch is configured for toggling for selectively coupling the first microprocessor to the first battery for powering the earpiece, a first distress button coupled to the first housing, the first distress button being operationally coupled to the first microprocessor, the first distress button being selectively depressible wherein the first distress button is configured for depressing for signaling the first microprocessor, and a first volume controller coupled to the first housing, the first volume controller being operationally coupled to the first microprocessor wherein the first volume controller is positioned for signaling the first microprocessor for selectively adjusting a volume of the first speaker; and the navigation and communications module comprising:

a second housing coupled to and extending linearly from the upper end of the rod, the second housing defining an internal space, the GPS transceiver being coupled to the second housing and positioned in the internal space, a second battery coupled to the second housing and positioned in the internal space, a second microprocessor coupled to the second housing and positioned in the internal space, the second microprocessor being operationally coupled to the second battery and the GPS transceiver, and a second transceiver coupled to the second housing and positioned in the internal space, the second transceiver being operationally coupled to the second microprocessor wherein the second transceiver is positioned for receiving a distress signal from the first transceiver upon depressing of the first distress button positioning the second microprocessor for actuating the GPS transceiver for communicating a distress signal and location coordinates to emergency services.

2. The tool of claim 1, further including the rod comprising a plurality of nested sections such that the rod is selectively extensible.

3. The tool of claim 2, further including the plurality of nested sections comprising six nested sections.

4. The tool of claim 1, further including the rod being colored to designate the user as being at least one of visually impaired and blind.

5. The tool of claim 1, further including a strap having opposing ends coupled to the second housing defining a loop wherein the loop is configured for inserting the hand of the user for coupling the rod to the user.

6. The tool of claim 1, further including the first volume controller comprising an increase button and a decrease button, the increase button and the decrease button being depressible wherein the increase button is configured for depressing for increasing the volume of the first speaker and the decrease button is configured for depressing for decreasing the volume of the first speaker.

7. The tool of claim 1, further including a grip coupled to the second housing wherein the grip is configured for enhancing a grasp of the hand of the user upon the second housing.

8. The tool of claim 1, further comprising:

a second speaker coupled to an upper face of the second housing, the second speaker being operationally coupled to the second microprocessor wherein the second microprocessor is positioned for selectively actuating the second speaker for broadcasting the directions and the warning of the respective hazard to the user; and a second volume controller coupled to the upper face of the second housing, the second volume controller being operationally coupled to the second microprocessor wherein the second volume controller is positioned for signaling the second microprocessor for selectively adjusting a volume of the second speaker.

9. The tool of claim 8, further including the second volume controller being slide-switch type wherein a knob of the second volume controller is configured for selectively sliding relative to the upper face of the second housing for increasing and decreasing the volume of the second speaker.

10. The tool of claim 8, further including a clock coupled to the second housing and positioned in the internal space, the clock being operationally coupled to the second microprocessor wherein the clock is positioned for signaling a time to the second microprocessor positioning the second microprocessor for selectively actuating the first speaker and the second speaker for broadcasting the time to the user.

11. The tool of claim 1, further including a navigational controller coupled to the upper face of the second housing, the navigational controller being operationally coupled to the second microprocessor wherein the navigational controller is configured for selecting from a plurality of preset destinations positioning the second microprocessor for actuating the GPS transceiver for directing the user on a route to a respective preset destination.

12. The tool of claim 11, further including the navigational controller comprising a set of three navigation buttons, the navigation buttons being depressible wherein each navigation button is configured for depressing for signaling the second microprocessor for actuating the GPS transceiver for directing the user on the route to the respective preset destination.

13. The tool of claim 11, further including navigational programming code positioned on an electronic device of the user enabling the user for communicating with the navigation and communications module via the second transceiver for inputting the plurality of preset destinations into the second microprocessor.

14. The tool of claim 13, further including tracking programming code positioned on the electronic device of the user enabling the user for granting access to another party for receiving the location coordinates from the GPS transceiver.

15. The tool of claim 1, further including a second switch coupled to the upper face of the second housing, the second switch being operationally coupled to the second microprocessor and the second battery, the second switch being toggle type wherein the second switch is configured for toggling for selectively coupling the second microprocessor to the second battery for powering the navigation and communications module.

16. The tool of claim 1, further including a second distress button coupled to the second housing, the second distress button being operationally coupled to the second microprocessor, the second distress button being selectively depressible, wherein the second distress button is configured for depressing for signaling the second microprocessor for actuating the GPS transceiver for communicating the distress signal and the location coordinates to the emergency services.

17. A mobility tool comprising:

a rod, the rod comprising a plurality of nested sections such that the rod is selectively extensible, the plurality of nested sections comprising six nested sections, the rod being colored to designate a user as being at least one of visually impaired and blind;

an earpiece comprising a first speaker, the earpiece being configured for positioning on an ear of the user such that the first speaker is positioned proximate to an ear canal of the ear, the earpiece comprising:

a first housing defining an interior space, the first speaker being coupled to and extending from the first housing, an earhook coupled to and extending arcuately from the first housing wherein the earhook is configured for positioning over a top of the ear for coupling the first housing to the user, a first battery coupled to the first housing and positioned in the interior space, a first microprocessor coupled to the first housing and positioned in the interior space, the first microprocessor being operationally coupled to the first battery and the first speaker, a first transceiver coupled to the first housing and positioned in the interior space, the first transceiver being operationally coupled to the first microprocessor, a first switch coupled to the first housing, the first switch being operationally coupled to the first microprocessor and the first battery, the first switch being toggle type wherein the first switch is configured for toggling for selectively coupling the first microprocessor to the first battery for powering the earpiece, a first distress button coupled to the first housing, the first distress button being operationally coupled to the first microprocessor, the first distress button being selectively depressible wherein the first distress button is configured for depressing for signaling the first microprocessor, and a first volume controller coupled to the first housing, the first volume controller being operationally coupled to the first microprocessor wherein the first volume controller is positioned for signaling the first microprocessor for selectively adjusting a volume of the first speaker, the first volume controller comprising an increase button and a decrease button, the increase button and the decrease button being depressible wherein the increase button is configured for depressing for increasing the volume of the first speaker and the decrease button is configured for depressing for decreasing the volume of the first speaker;

a sensing module coupled to a lower end of the rod, the sensing module comprising a temperature sensor, a moisture sensor, and a motion sensor wherein the sensing module is configured for detecting a temperature hazard, a water hazard, and a traffic hazard;

a navigation and communications module coupled to an upper end of the rod, the navigation and communications module being operationally coupled to the sensing module and the earpiece, the navigation and communications module comprising a GPS transceiver wherein the GPS transceiver is configured for receiving location coordinates, wherein the sensing module is configured for detecting a respective hazard along a route positioning the first speaker for selectively broadcasting directions for the route and a warning of the respective hazard to the user, the navigation and communications module comprising:

a second housing coupled to and extending linearly from the upper end of the rod, the second housing defining an internal space, the GPS transceiver being coupled to the second housing and positioned in the internal space, a second battery coupled to the second housing and positioned in the internal space, a second microprocessor coupled to the second housing and positioned in the internal space, the second microprocessor being operationally coupled to the second battery and the GPS transceiver, a second transceiver coupled to the second housing and positioned in the internal space, the second transceiver being operationally coupled to the second microprocessor wherein the second transceiver is positioned for receiving a distress signal from the first transceiver upon depressing of the first distress button positioning the second microprocessor for actuating the GPS transceiver for communicating a distress signal and location coordinates to emergency services, a second speaker coupled to an upper face of the second housing, the second speaker being operationally coupled to the second microprocessor wherein the second microprocessor is positioned for selectively actuating the second speaker for broadcasting the directions and the warning of the respective hazard to the user, a navigational controller coupled to the upper face of the second housing, the navigational controller being operationally coupled to the second microprocessor wherein the navigational controller is configured for selecting from a plurality of preset destinations positioning the second microprocessor for actuating the GPS transceiver for directing the user on a route to a respective preset destination, the navigational controller comprising a set of three navigation buttons, the navigation buttons being depressible wherein each navigation button is configured for depressing for signaling the second microprocessor for actuating the GPS transceiver for directing the user on the route to the respective preset destination, a clock coupled to the second housing and positioned in the internal space, the clock being operationally coupled to the second microprocessor wherein the clock is positioned for signaling a time to the second microprocessor positioning the second microprocessor for selectively actuating the first speaker and the second speaker for broadcasting the time to the user, a second switch coupled to the upper face of the second housing, the second switch being operationally coupled to the second microprocessor and the second battery, the second switch being toggle type wherein the second switch is configured for toggling for selectively coupling the second microprocessor to the second battery for powering the navigation and communications module, a second distress button coupled to the second housing, the second distress button being operationally coupled to the second microprocessor, the second distress button being selectively depressible, wherein the second distress button is configured for depressing for signaling the second microprocessor for actuating the GPS transceiver for communicating the distress signal and the location coordinates to the emergency services, and a second volume controller coupled to the upper face of the second housing, the second volume controller being operationally coupled to the second microprocessor wherein the second volume controller is positioned for signaling the second microprocessor for selectively adjusting a volume of the second speaker, the second volume controller being slide-switch type wherein a knob of the second volume controller is configured for selectively sliding relative to the upper face of the second housing for increasing and decreasing the volume of the second speaker;

a grip coupled to the second housing wherein the grip is configured for enhancing a grasp of the hand of the user upon the second housing;

a strap having opposing ends coupled to the second housing defining a loop wherein the loop is configured for inserting the hand of the user for coupling the rod to the user;

navigational programming code positioned on an electronic device of the user enabling the user for communicating with the navigation and communications module via the second transceiver for inputting the plurality of preset destinations into the second microprocessor; and tracking programming code positioned on the electronic device of the user enabling the user for granting access to another party for receiving the location coordinates from the GPS transceiver.

* * * * *